US008371080B2

(12) United States Patent
Wrightman

(10) Patent No.: US 8,371,080 B2
(45) Date of Patent: Feb. 12, 2013

(54) LOG WALL CONNECTOR SYSTEM

(75) Inventor: Robert A. Wrightman, Bracebridge (CA)

(73) Assignee: Robert A. Wrightman, Bracebridge (CA)

( * ) Notice: Subject to any disclaimer, the term of this patent is extended or adjusted under 35 U.S.C. 154(b) by 452 days.

(21) Appl. No.: 11/892,870

(22) Filed: Aug. 28, 2007

(65) Prior Publication Data

US 2009/0056251 A1 Mar. 5, 2009

(51) Int. Cl.
*E04B 1/10* (2006.01)

(52) U.S. Cl. ..... 52/233; 52/590.1; 52/741.13; 52/586.2; 52/591.1

(58) Field of Classification Search ..... 52/233, 52/590.1, 741.13, 313, 586.1, 586.2, 595.1, 52/591.1, 585.1; 446/106; 403/231, 388
See application file for complete search history.

(56) References Cited

U.S. PATENT DOCUMENTS

| | | | | |
|---|---|---|---|---|
| 1,813,455 | A * | 7/1931 | Lawton | 52/233 |
| 2,498,551 | A | 2/1950 | Jonsrud | |
| 3,166,802 | A | 1/1965 | Schmidgall | |
| 3,189,950 | A | 6/1965 | Johnson | |
| D203,663 | S | 2/1966 | Blum et al. | |
| 3,381,428 | A | 5/1968 | Sillman | |
| 3,440,784 | A | 5/1969 | Onjukha | |
| 3,552,079 | A | 1/1971 | Mortensen | |
| 4,126,977 | A * | 11/1978 | Chisum | 52/233 |
| 4,279,108 | A | 7/1981 | Collister, Jr | |
| 4,599,837 | A | 7/1986 | Wrightman | |
| 4,901,489 | A | 2/1990 | Garber | |
| 4,938,263 | A | 7/1990 | Wrightman | |
| 5,020,289 | A | 6/1991 | Wrightman | |
| 5,325,645 | A | 7/1994 | Wrightman | |
| 5,403,109 | A * | 4/1995 | Johnson et al. | 403/231 |

(Continued)

FOREIGN PATENT DOCUMENTS

| | | |
|---|---|---|
| CA | 1264644 | 1/1990 |
| CA | 1273468 | 9/1990 |

(Continued)

OTHER PUBLICATIONS

"Distinctive Homes—Log, Timberframe, Conventional Log Sided and More . . . " Catalogue published by True North Log Homes. Inc. 2007. p. 200 (photocopy of page is enclosed showing prior cross sections of logs.).

(Continued)

*Primary Examiner* — William Gilbert
*Assistant Examiner* — Chi Q Nguyen
(74) *Attorney, Agent, or Firm* — John R. S. Orange; Blake, Cassels & Graydon LLP

(57) ABSTRACT

A building structure comprises a post having a vertically extending longitudinal face. A plurality of horizontal logs extends from said longitudinal face and has an end face in abutment with said longitudinal face. The post having an undercut channel in said longitudinal face and extends along said post. At least one of said end faces has a recess aligned with said undercut channel, and a spline assembly extends between said post and said log to secure said log to said post. The spline assembly includes a key located in and extends between said channel and said recess and an insert in one of said undercut channel and said recess. The insert co operates with said key to facilitate relative sliding movement therebetween.

22 Claims, 13 Drawing Sheets

U.S. PATENT DOCUMENTS

| | | | | |
|---|---|---|---|---|
| 5,778,950 | A | 7/1998 | Wrightman | |
| 5,799,452 | A * | 9/1998 | Moore | 52/233 |
| 5,823,700 | A * | 10/1998 | Poworoznek | 403/245 |
| 6,050,033 | A | 4/2000 | Wrightman | |
| 6,186,691 | B1 * | 2/2001 | Rudolf-Bauer | 403/31 |
| 6,272,802 | B1 * | 8/2001 | Berberich | 52/233 |
| 6,363,672 | B1 * | 4/2002 | Baker | 52/233 |
| D467,010 | S | 12/2002 | Wrightman | |
| 7,223,045 | B2 * | 5/2007 | Migli | 403/409.1 |
| 2005/0268563 | A1 | 12/2005 | Wrightman | |

FOREIGN PATENT DOCUMENTS

| | | |
|---|---|---|
| CA | 2002665 | 12/1991 |

OTHER PUBLICATIONS

"True North Log Homes Inc. Plan book" (photocopies of the two pages are enclosed showing True North's patented technologies.).

* cited by examiner

LOG WALL CONNECTOR SYSTEM

BACKGROUND OF THE INVENTION

The present invention relates generally to wall structures and in particular to wall structures for post-and-log construction.

Log construction has been known for many decades as typified by the log cabin. For many years the logs have been notched so that at a corner logs forming one wall of a structure can be laid on top of and at an angle alternating with logs from an intersecting wall. In practical use, such construction is usually limited to right angle corners because of the complexity of the angled notches required for non-right angle corners. More recently, posts have been introduced that can be milled with longitudinal faces at a range of desirable angles such that wall members having square-cut ends can be attached by spikes to the posts to form right-angle or non-right angle corners. Although a number of materials may be used to form the "logs" used as wall members, including various types of composite materials, the wall members are typically milled from wood. The term "logs" will be used throughout this disclosure to include all types of materials that simulate a horizontal wooden log and includes different cross sections, either machined, hand-hewn or in a natural state.

To form a tight connection between die logs and the posts, split key members have been used that engage cooperating undercut recesses in the end of the log and a face of the post. In U.S. Pat. No. 6,050,033 there is disclosed a spline arrangement in which the log and post are connected by a key formed by a pair of wedges. The key is expandable and secured the log to the post. A first section of the key member is fitted into place to engage the recesses in the post and the log and then a second section of the key member is inserted and tapped into place beside the first section of the key member. The cross-sections of the split key member are wedge-shaped and tighten the joint as the second portion of the key member is tapped into place.

It is necessary to ensure that the interconnecting butt joints are tight and provide an effective seal, but at the same time accommodate relative movement between logs whilst maintaining a seal. This is particularly an issue in wooden log construction because of the shrinkage of the logs as they dry. This causes the logs to settle and move vertically down. However, in some circumstances the connection of the key to both the log and the post as shown in U.S. Pat. No. 6,050,033 may inhibit such movement and as a result a gap is created between adjacent logs in the log walls.

It is an object of the present invention to obviate or mitigate the above disadvantages.

SUMMARY OF THE INVENTION

According to one aspect of the invention, a building structure comprises a post having a vertically extending longitudinal face, a plurality of horizontal logs extending from said longitudinal face and having an end face in abutment with the longitudinal face. The post has an undercut channel in the longitudinal face and extends along the post. At least one of the end faces has a recess aligned with the undercut channel and a spline assembly extends between the post and the log to secure the log to the post. The spline assembly includes a key located in and extending between the undercut channel and the recess and a key slide in one of the undercut channel and the recess. The key slide co operates with the key to facilitate relative sliding movement of the logs and the post.

A further aspect of the invention provides a spline assembly to secure a log to a post in building, said spline assembly including a key slide for insertion into an undercut channel in said post and a key for insertion into said key slide and a recess in said log to extend between said log and inhibit separation thereof.

A still further aspect of the invention provides a method of assembling a log to a post comprising the steps of providing an undercut channel in a longitudinal face of the post, inserting in the undercut channel providing a recess in the log, aligning the recess with the key slide undercut channel, inserting a key into the key slide to extend between the post and the log, and securing the key to the recess, whereby relative movement between the log and the post is accommodated by relative sliding movement between the key slide and the key.

BRIEF DESCRIPTION OF THE DRAWINGS

The principles of the various aspects of the invention may better be understood by reference to the accompanying illustrative drawings which depict features of examples of embodiments of the invention, and in which.

DETAILED DESCRIPTION OF THE INVENTION

Figure 1:
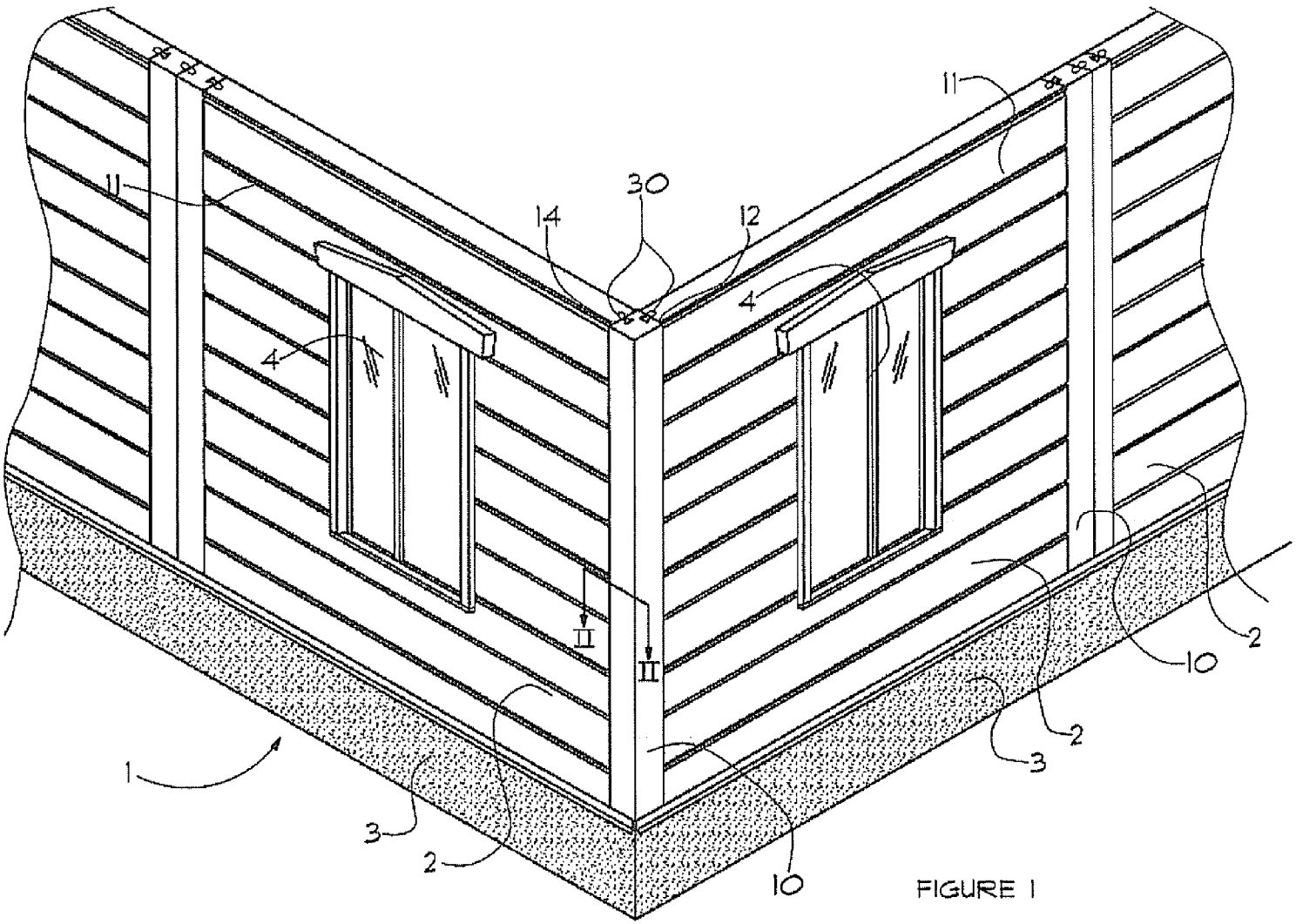
FIG. 1 is a perspective view of a building.

The description that follows and the embodiments described therein are provided by way of illustration of examples of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

Referring therefore to FIG. 1, a building 1 includes a pair of log walls 2 that intersect at a post 10. The log walls 2 are supported on a foundation wall 3, that may be poured concrete or laid block, and have openings for windows 4. The log walls 2 will support a roof or additional framed storey in a conventional manner. The log walls 2 are formed from horizontal logs 11 that are laid horizontally one on top of the other and are secured to the corner post 10 to form an integral structure.

Figure 4:
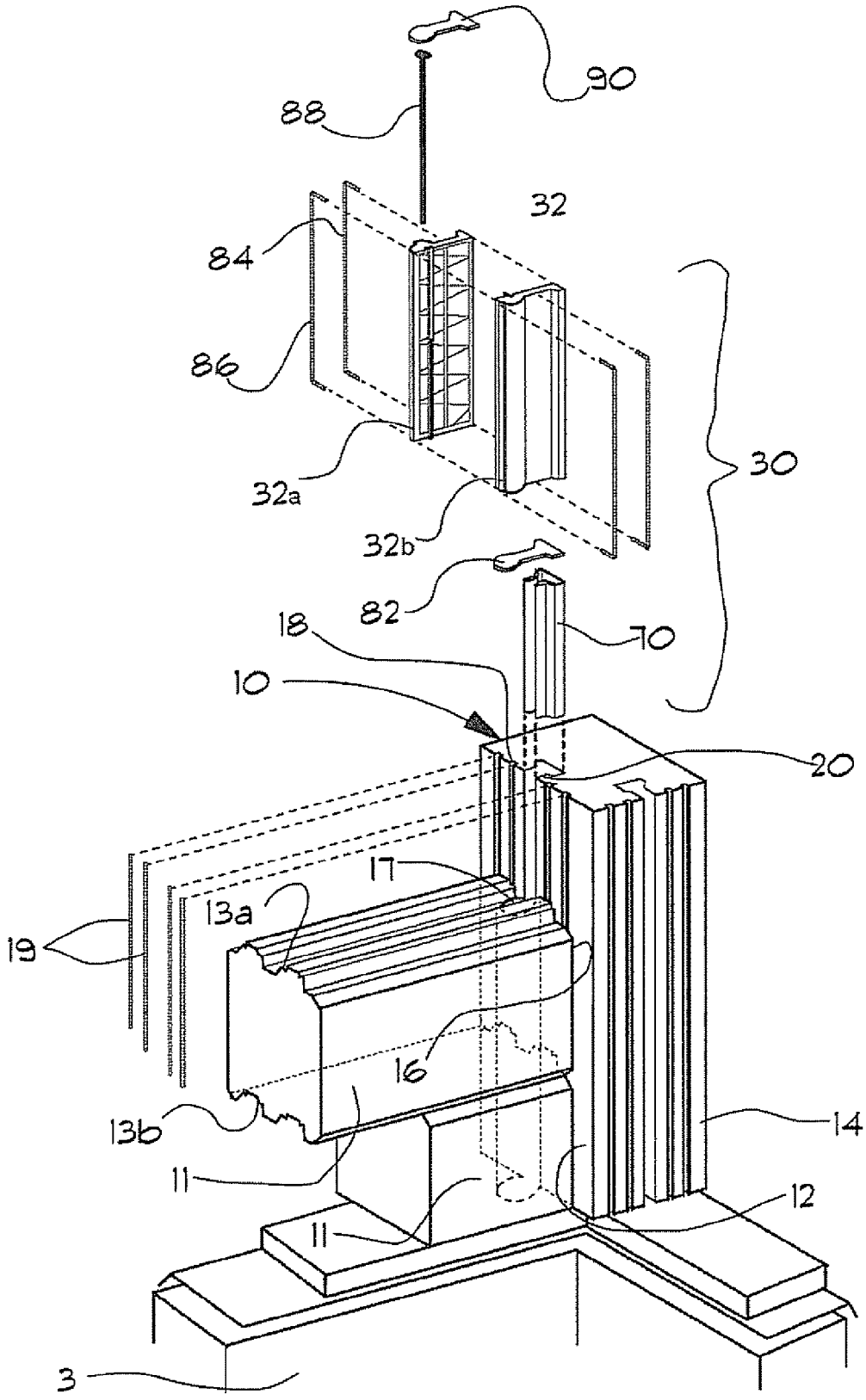
FIG. 4 is an exploded view of the components shown in FIG. 3.

Each of the logs 11 is machined to a uniform cross section and have complementary tongues and grooves formed on abutting faces, upper and lower faces 13*a*, 13*b* (FIG. 4). A sealant, typically in the form of a mastic tape, is located between the tongue and groove and compressed by the log to form an effective seal. The particular form of tongue and groove forms no part of the present invention and a variety of configurations may be used, such as that shown in U.S. Pat. No. 5,020,289.

It will be appreciated that the log walls 2 extend around the periphery of the building 1 and the logs 11 are cut to the required length to conform to the desired floor plan.

The post 10 extends vertically the height of the wall 2 and each post 10 has a pair of generally planar faces 12, 14, that are disposed at an included angle corresponding to the corner of the building 1. Typically, the faces 12, 14 intersect at right angles but other included angles can be provided, as shown in FIG. 7.

Figure 2:
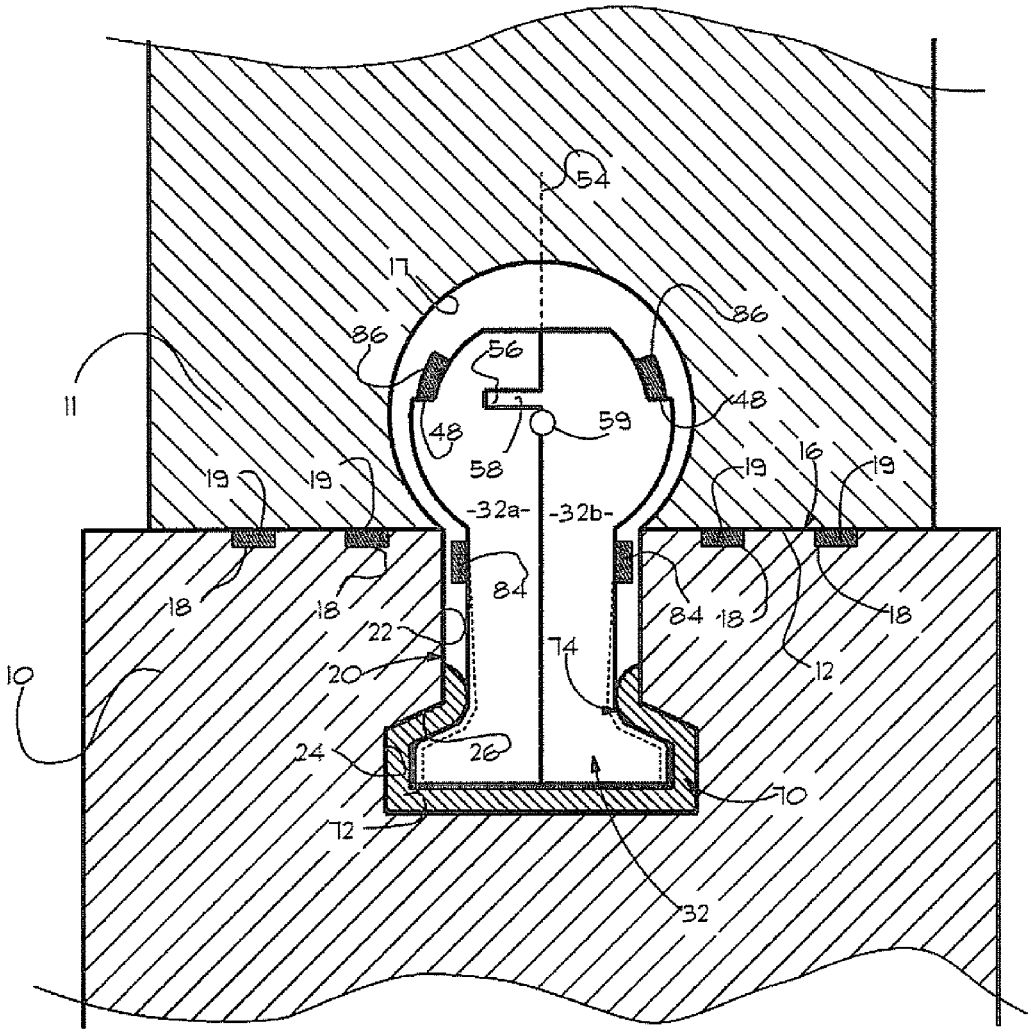
FIG. 2 is a view on the line II-II of FIG. 1 showing components as assembled.

As can best be seen in FIG. 2, each of the logs 11 has an end face 16 that extends between the upper and lower faces 13*a*, 13*b* to butt against one of the faces 12, 14 of the post 10. The end face 16 has a part cylindrical slot 17 extending between the upper and lower faces 13*a*, 13*b* of the log 11 and intersecting the end face 16 so as to define a re-entrant recess in the end face 16.

Sealant slots 18 are provided along the length of each of the faces 12, 14 of post 10. The sealant slots 18 are dimensioned to accept sealant materials, typically in the form of butyl or impregnated foam tapes 19 that are exposed to the end face 16 when a log 11 is butted against post 10.

Each of the faces 12, 14 has an undercut channel 20 extending along the length of the post 10. The undercut channel 20 has a parallel sided body portion 22 which opens to an enlarged socket 24. Inclined flanks 26 connect the body portion 22 to the enlarged socket 24. The width of the body portion 22 corresponds to that of the part cylindrical slot 17 at the end face 16.

The logs 11 are held against the respective face 12, 14 by the spline assembly generally indicated at 30 in FIG. 4. The spline assembly 30 includes a key 32 and a key slide 70. The key 32 has a pair of key members 32*a*, 32*b* that are identical to one another and have a length slightly less than the corresponding height of the log 11. For example, with a log of nominal 12" height, the key 32 will typically be 10" in length.

Figure 5:
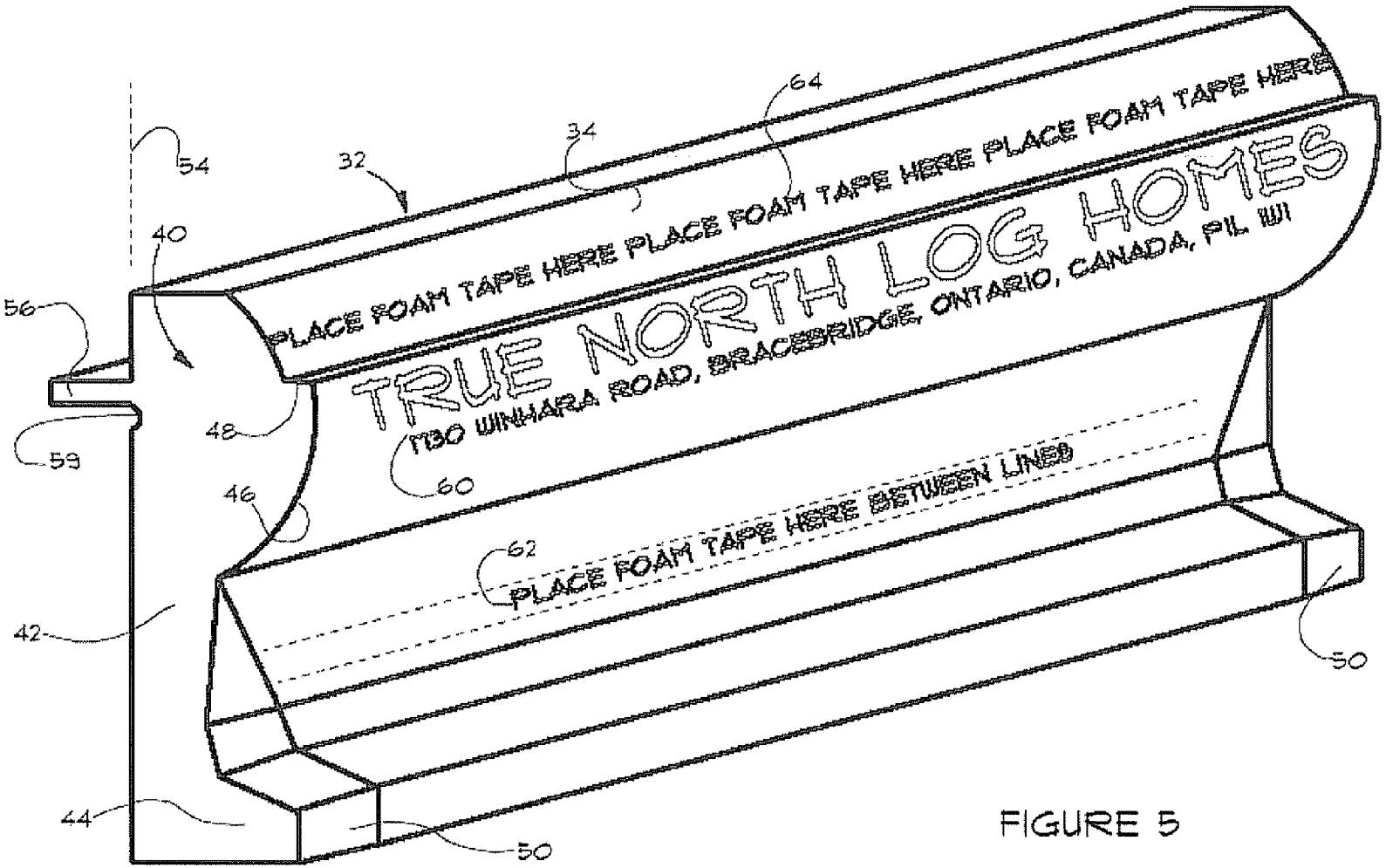
FIG. 5 is a perspective view of a key member used in the embodiment of FIGS. 1 to 4.
Figure 6:
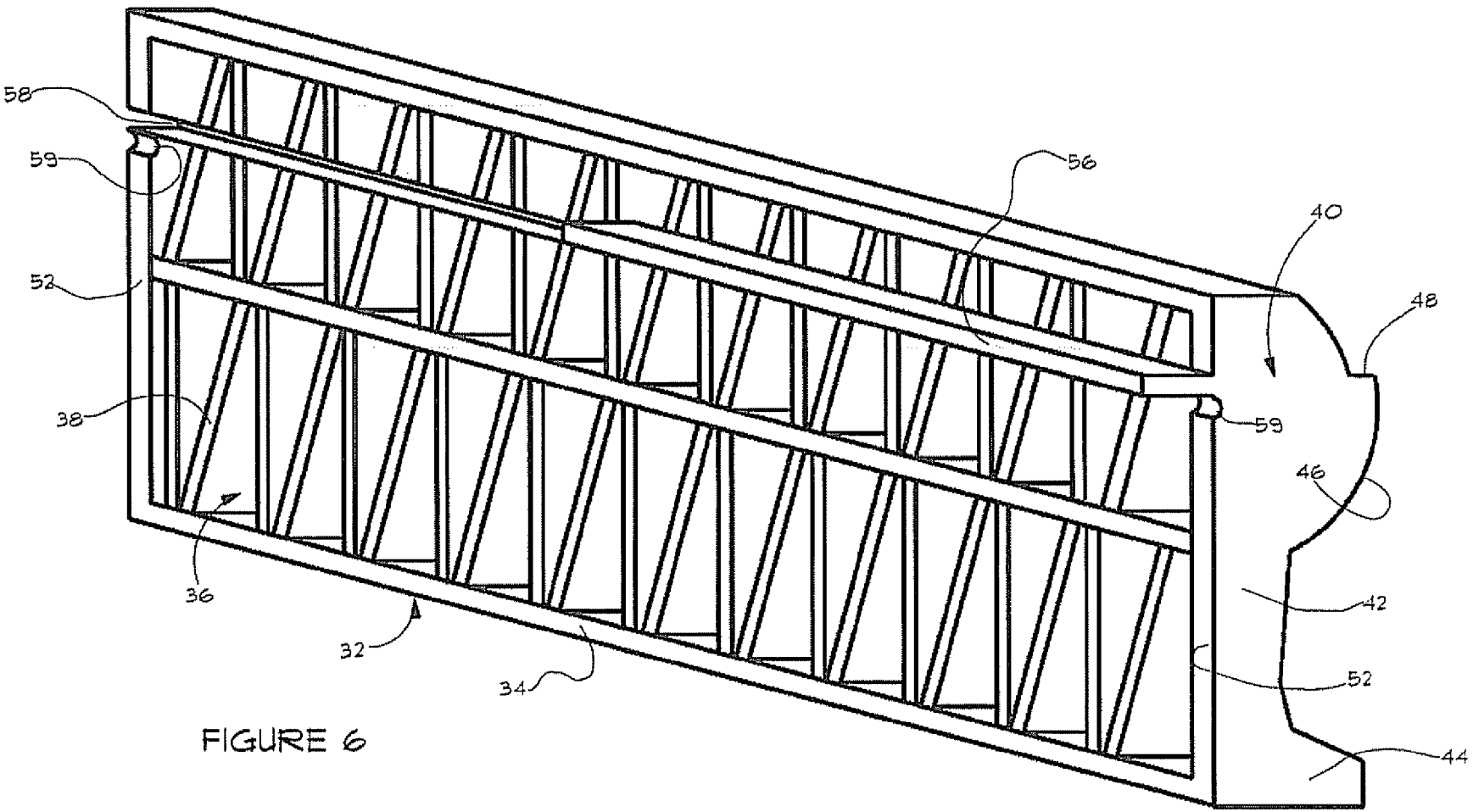
FIG. 6 is a rear perspective of the key member of FIG. 5.

The key members 32*a*, 32*b* are best seen in FIGS. 5 and 6. Each key member 32*a*, 32*b* is molded from a plastics material and has an outer shell 34 with a hollow interior 36 with reinforcing ribs 38 integrally molded with the outer shell 34. In cross section, each of the key members 32*a*, 32*b* is similar to one half of the void formed between the part cylindrical slot 17, undercut channel 20 and the key slide 70 so that a pair of key members 32*a*, 32*b* may be inserted within the void.

Each of the key members 32*a*, 32*b* has an enlarged head 40 connected by a neck 42 to a flared shoulder 44. The enlarged head 40 has an arcuate undersurface 46 terminating in radial step 48. Each end of the key members 32*a*, 32*b* has a tapered terminal section 50 on the neck 42 and the flared shoulder 44 to facilitate insertion in to the key slide 70. End walls 52 enclose the shell at each end up to a median plane 54. A flange 56 projects outwardly from the median plane 54 at one end and extends one half the length of the key member 32*a*, 32*b*. A slot 58 having a depth slightly greater than that of the flange 56 is molded into the key member 32*a*, 32*b* in alignment with the flange 56 over the balance of the length of the key member 32*a*, 32*b*. A notch 59 is formed in each end wall 52 beside the flange 56 and slot 58 respectively.

The flange 56 and slot 58 are arranged such that when two key members 32*a*, 32*b* are placed back to back, the flange 56 of one is received in the slot 58 of the other, so a continuous barrier is provided along the length of the key members 32*a*, 32*b*. It will be noted from FIG. 5 that the arcuate undersurface 46 has embossments 60 molded along its length. The embossments 60 are in the form of letters in the embodiment shown that project slightly above the undersurface 46. Similar embossments 62, 64 are molded on the neck 42 and above the radial step 48.

Figure 8:
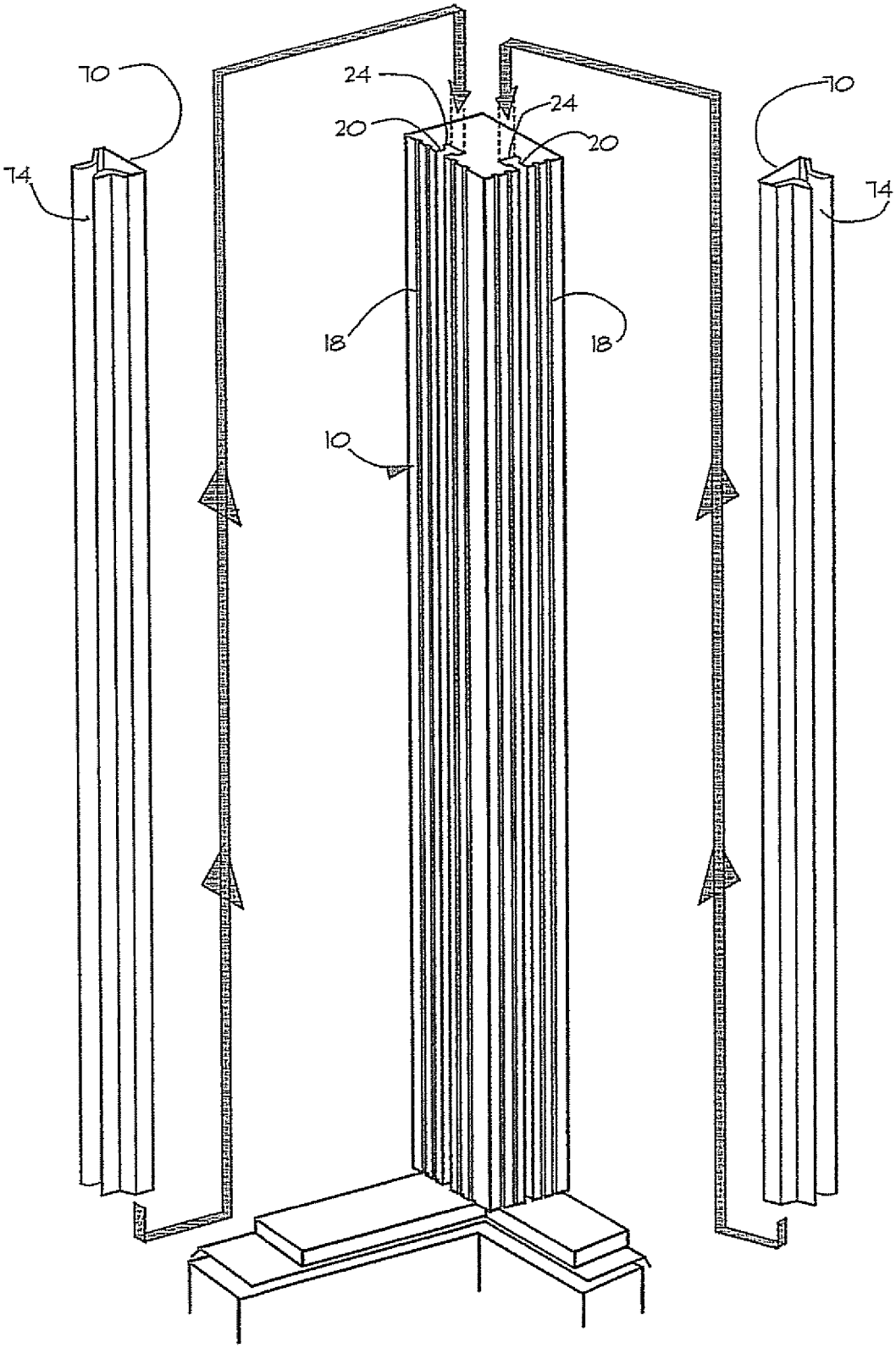
FIG. 8 is an exploded view of components used in the building of FIG. 1.

As can best be seen in FIGS. 2,4 and 8, the key slide 70 of the spline assembly 30 is an elongate channel member arranged to be a sliding fit within the enlarged socket 24 of the undercut channel 20. The key slide 70 extends the full height of the post 10 as a continuous member and is inserted into the enlarged socket 24 of undercut channel 20 after machining of the post 10. The key slide 70 is dimensioned to have contact with the parallel sided body portion 22 of the undercut channel 20, inclined flanks 26 and enlarged socket 24 in its free body state so as to be retained within the undercut channel 20 during transport of the post 10 and subsequent assembly of the log walls 2 and the post 10.

Figure 3:
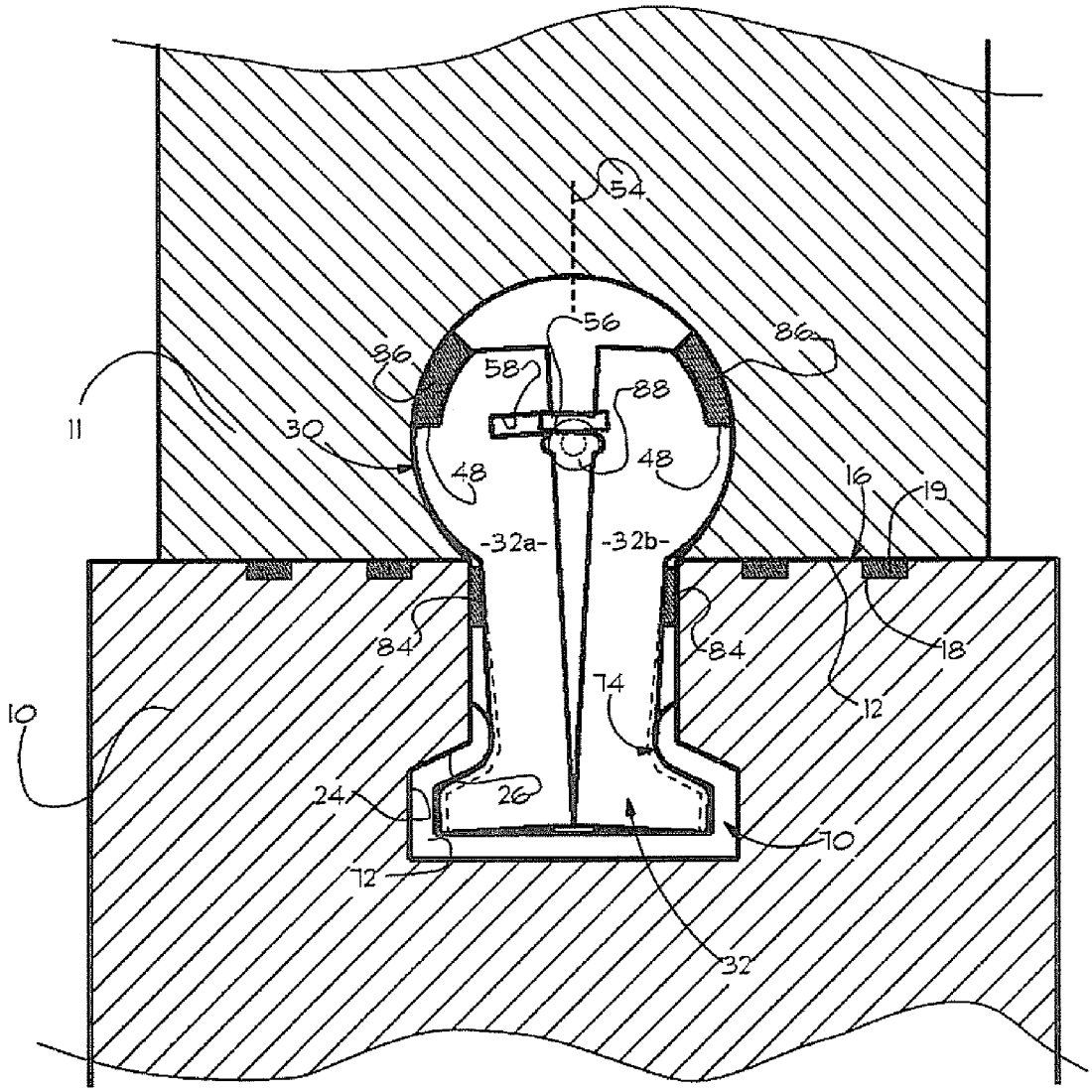
FIG. 3 is a view similar to FIG. 2 with the components in a locked condition.

As can best be seen in FIGS. 2, 3 and 8, the key slide 70 has an outer surface that conforms substantially to the enlarged socket 24. The key slide 70 has a throat 74 that extends into the body portion 22 with the inwardly directed surfaces of the throat 74 radiussed so as to provide a rolling contact between the junction of the neck 42 and the flared shoulder 44 of each of the key members 32*a*, 32*b*. The key slide 70 is of substantially uniform thickness so as to be a snug sliding fit within the enlarged socket 24 and allow the neck 42 and flared shoulder 44 of key 32 to be a sliding fit within the key slide 70.

The key slide 70 is formed of a suitable material having the requisite thermal insulation qualities, low surface friction, hardness and durability. A thermo-plastic material such as polyethylene or polypropylene is suitable. Polypropylene has a relatively low surface friction to facilitate insertion and to provide a smooth sliding surface between the key 32 and the key slide 70.

The assembly of the log walls 2 shown in FIG. 1 is best seen with reference to the sequence represented in FIG. 7. Initially, a flashing F is secured to the foundation wall 3 and two rows of butyl tape 80 are applied toward the exterior of the building. The paper covering found on the butyl tape is left in situ to allow for slight adjustment of the initial course of logs 11.

Figure 7A:
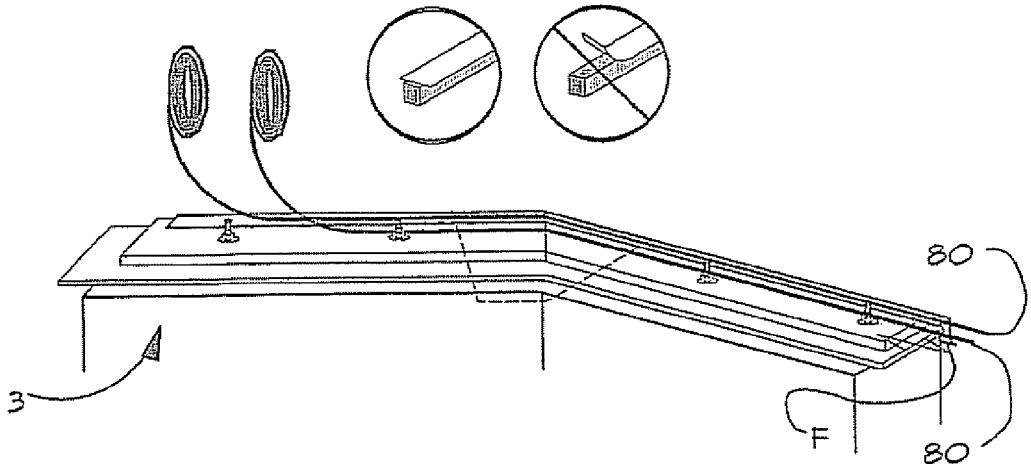
FIG. 7(*a*)-(*k*) is a schematic representation of the steps of assembling the building of FIG. 1.
Figure 7B:
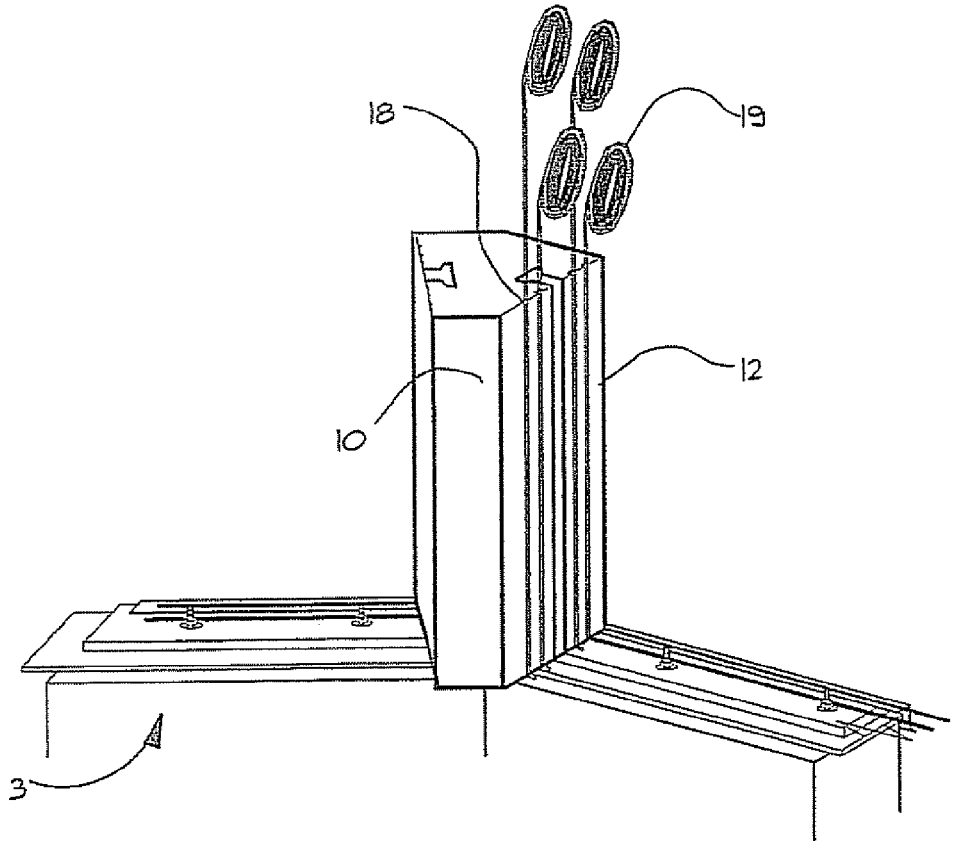

With the two rows of butyl tape 80 installed on the flashing F, the post 10 is placed on the foundation wall 3 and foam tape 19 inserted into each of the sealant slots 18 on one face 12 of the post 10 (FIG. 7*b*). The surface of the foam tape 19 immediately adjacent the work area is revealed by removal of the paper covering, which progresses along the length of the post 10 as the log wall 2 is assembled.

Figure 7C:
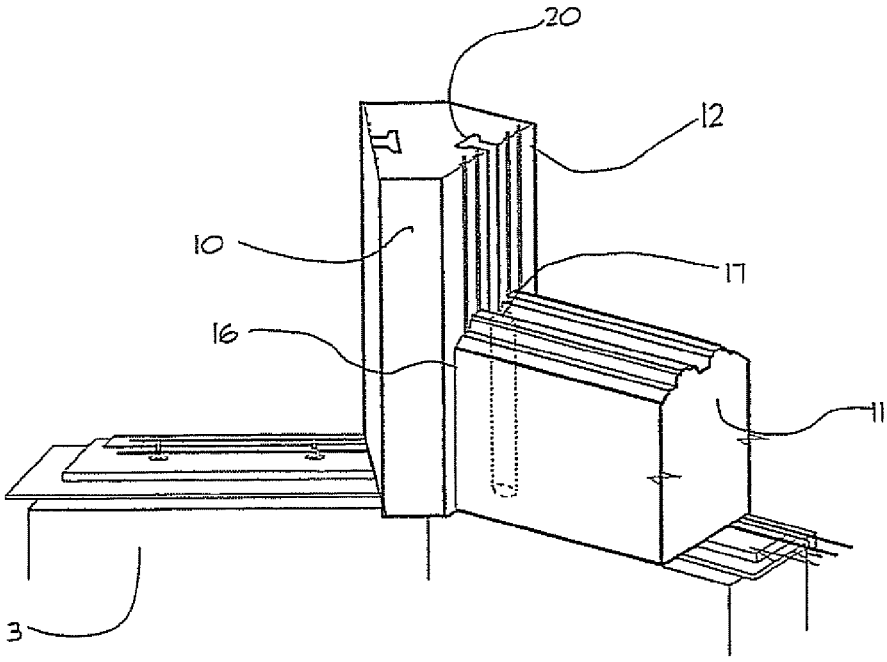
Figure 7D:
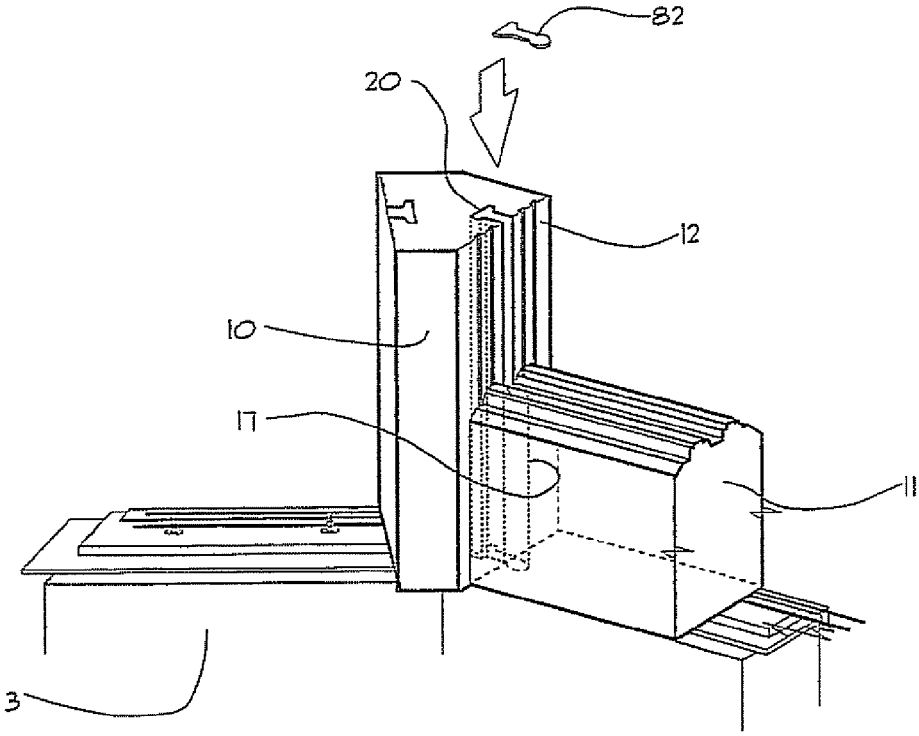

The initial log 11 is then placed against the post 10 with the end face 16 in abutment with the face 12 (FIG. 7*c*). In this position, the part cylindrical slot 17 is aligned with the undercut channel 20. An asphalt impregnated foam pad 82 conforming to the shape of the part cylindrical slot 17 and undercut channel 20 is inserted from the top of the log 11 (FIG. 7*d*) and pushed down in the part cylindrical slot 17 until it reaches the top of the foundation wall 3.

Figure 7E:
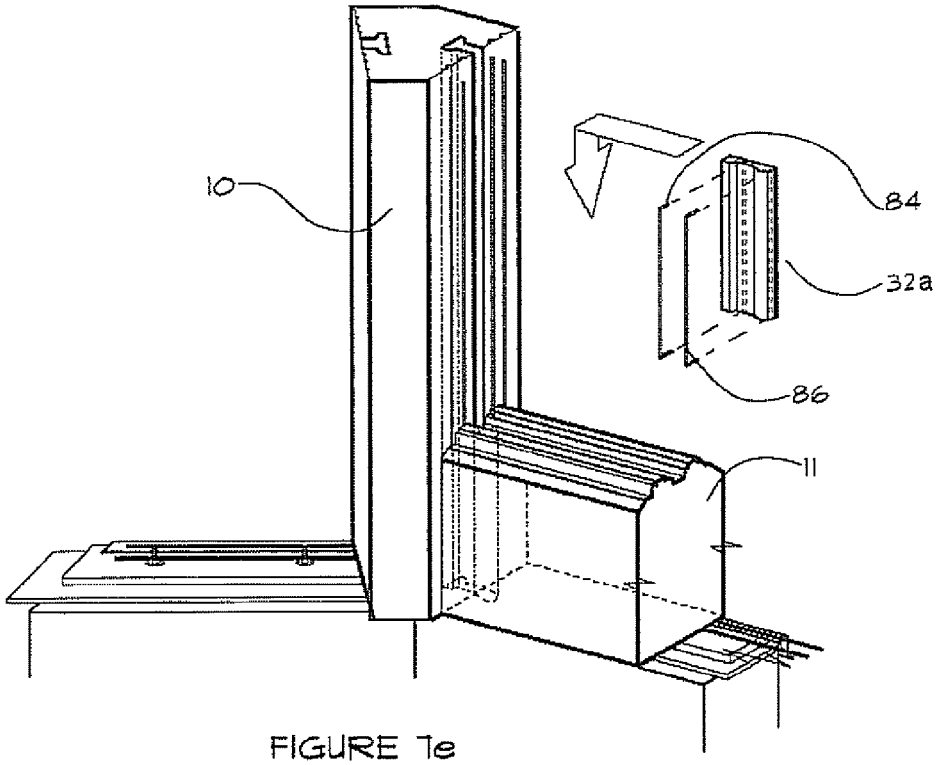
Figure 7F:
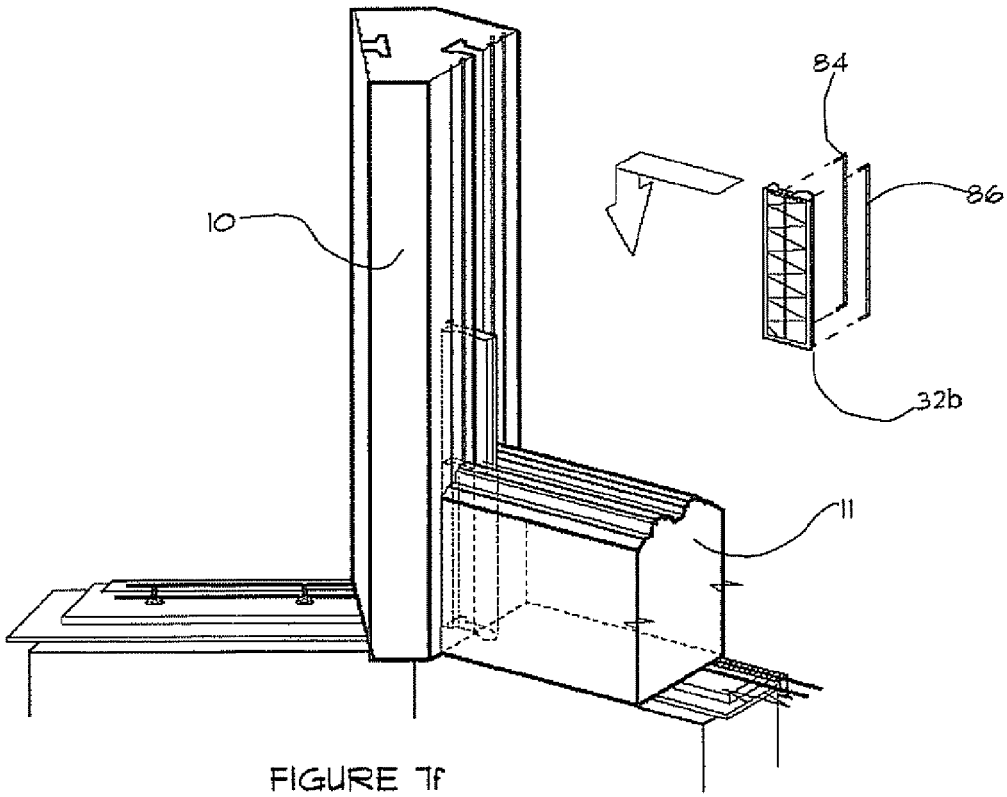
Figure 7G:
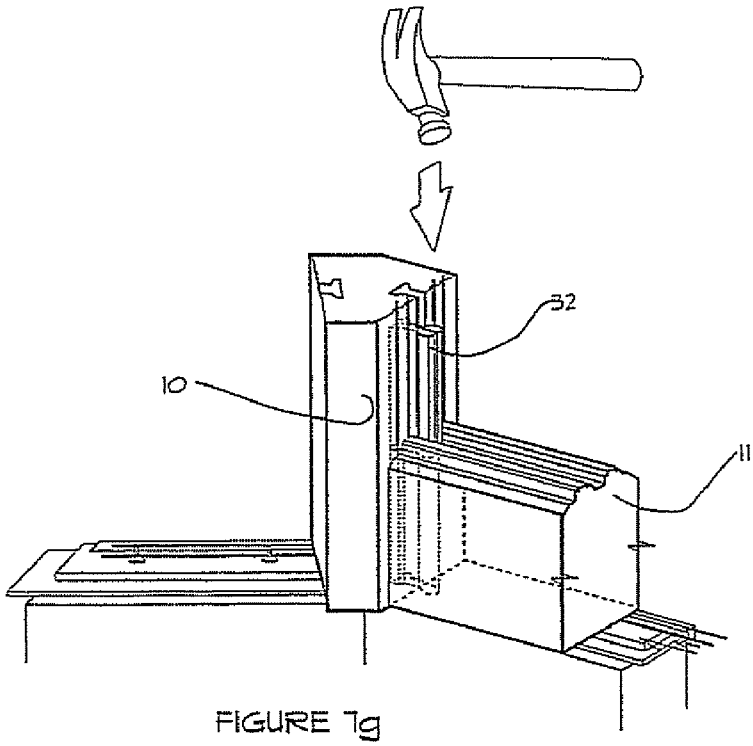

To secure the log 11 to the post 10, a key 32 is inserted, as shown in FIGS. 7*e* to 7*g*. Prior to insertion of the key 32 lengths of sealant tape 84, 86 are applied to the neck 42 directly on embossment 62 and to the enlarged head 40 directly on embossment 64 of each key member 32*a*, 32*b*. These locations are not initially in engagement with the parallel sided body portion 22 or the part cylindrical slot 17 during insertion and the sealant tape therefore remains in situ during insertion of the key 32. The sealant tape 84, 86 is held in situ during insertion by the inherent adhesiveness of the exposed surface of the sealant tape 84,86 and by engagement with the embossments 62,64 molded on the surface of the outer shell 34. When initially placed on the key member 32*a*, 32*b*, the sealant tape 84, 86 is in a compressed state as it has been removed from a roll of tape and progressively expands to its free body form. Each of the key members 32*a*, 32*b* is inserted into the key slide 70 individually such that the flared shoulder 44 may pass through the throat 74 of the key slide 70 (FIGS. 7*e* and 7*f*). The key member 32*a* is inserted with the flange 56 lower most. The key member 32*b* may then be inserted into the key slide 70 above the key member 32*a* and the two key members 32*a*, 32*b* slid together axially. The flange 56 on one key member 32*a* is received in the slot 58 of the other key member 32*b* as the key members 32*a*, 32*b* slide together to form the key 32.

Figure 7H:
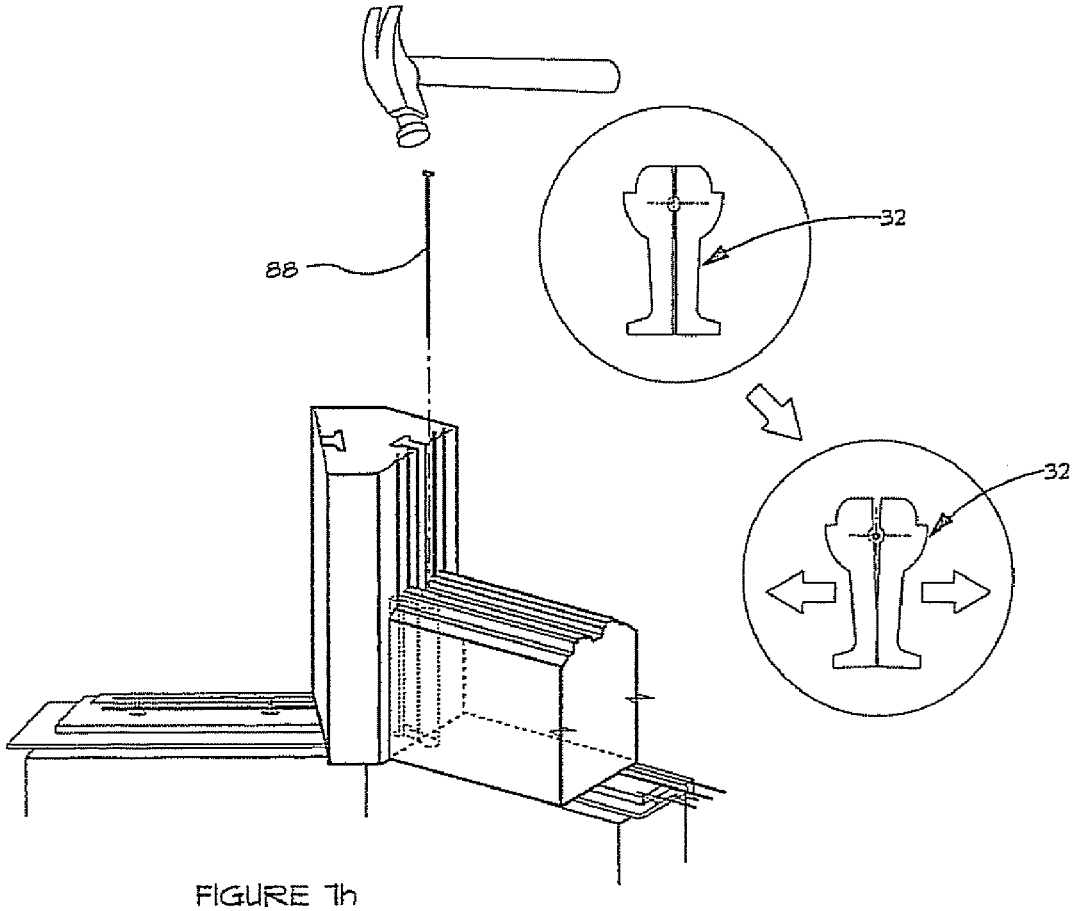

With the key members 32*a*, 32*b* assembled, they form the key 32 and may be pushed as a unit into the part cylindrical slot 17 (FIG. 7*g*) until they are flush with the bottom of the grooves provided in the top surface 13*a* of the log 11. At this time, the sealant 84, 86 has not expanded to its free body state, thereby avoiding contact with the walls of the part cylindrical slot 17 or parallel sided body portion 22 of the undercut channel 20. The key members 32*a*, 32*b* and key slide 70 are dimensioned such that the key 32 may slide relatively easily along the key slide 70 and into the part cylindrical slot 17. Typically a clearance in the order of ⅛ of an inch on the diameter is provided between the arcuate undersurface 46 and the cylindrical wall of the part cylindrical slot 17. However, the flared shoulders 44 extend laterally into key slide 70 within the enlarged socket 24 so as to inhibit removal of the key 32. With the key 32 correctly positioned, the key members 32*a*, 32*b* are forced apart within the part cylindrical slot 17 by insertion of a spike 88 along the length of the key member 32*a*, 32*b* (FIG. 7*h*). The spike 88 is inserted into the notch 59 provided adjacent the flange 56 and acts as a wedge to separate the key members 32*a*, 32*b*. The enlarged head 40 is dimensioned to prevent removal from the part cylindrical slot 17 in the locked condition as seen in FIG. 3. The flanges 56 act as a barrier to prevent lateral movement of the spike 88 from between the key members 32*a*, 32*b* and to cause a uniform spreading of the key 32 within the part cylindrical slot 17. The relatively small surface area of the reinforcing ribs 38 reduces the friction on the spike 88 and reduces the downward force transferred to the key members 32 by the spike 88. The initial expansion of the key members 32 also brings the embossments 60 in to engagement with the walls of part cylindrical slot 17 to inhibit further downward movement.

Figure 7I:
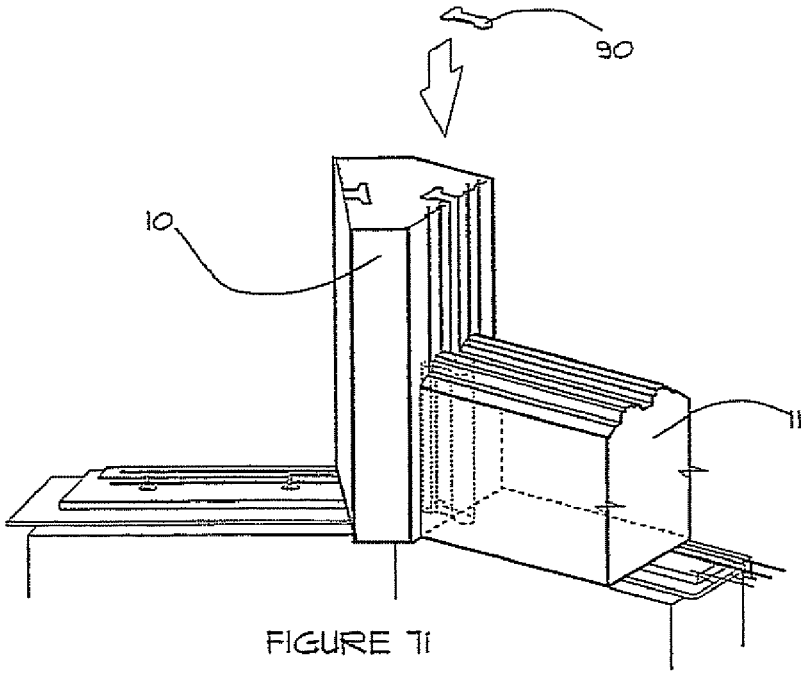

The spike 88 separates the key members 32*a*, 32*b* within the part cylindrical slot 17 but the inner edges of the flared shoulders 44 within the key slide 70 remain in contact with one another. As can be seen from a comparison between FIGS. 2 and 3, spreading of the key members 32*a*, 32*b* causes a rolling action about the curved surfaces of the throat 74 of the slide so as to provide essentially an outward force that is readily resisted by the material in the post 10, as opposed to a torque acting so as to break off the material at the body portion 22 of the undercut channel 20. At the same time, the sealant tape 84, 86 are compressed against the enlarged head 40 and part cylindrical slot 17 as well as the neck 42 and undercut channel 20 to provide a continuous uniform seal within the undercut channel 20 and part cylindrical slot 17 respectively. The spreading of the key members 32*a*, 32*b* as shown in FIG. 3 causes the log 11 to be drawn tightly against the face of the post 10 causing the foam tape 19 in sealant slots 18 to be similarly compressed to form a continuous seal. An asphalt impregnated foam pad 90 is then inserted onto the top of the key 32 to ensure a proper seal between adjacent key 32 (FIG. 7*i*). However, the reduced spreading within the key slide 70 in combination with the low friction material of the key slide facilitates sliding movement of the key 32 along the key slide 70.

Figure 7J:
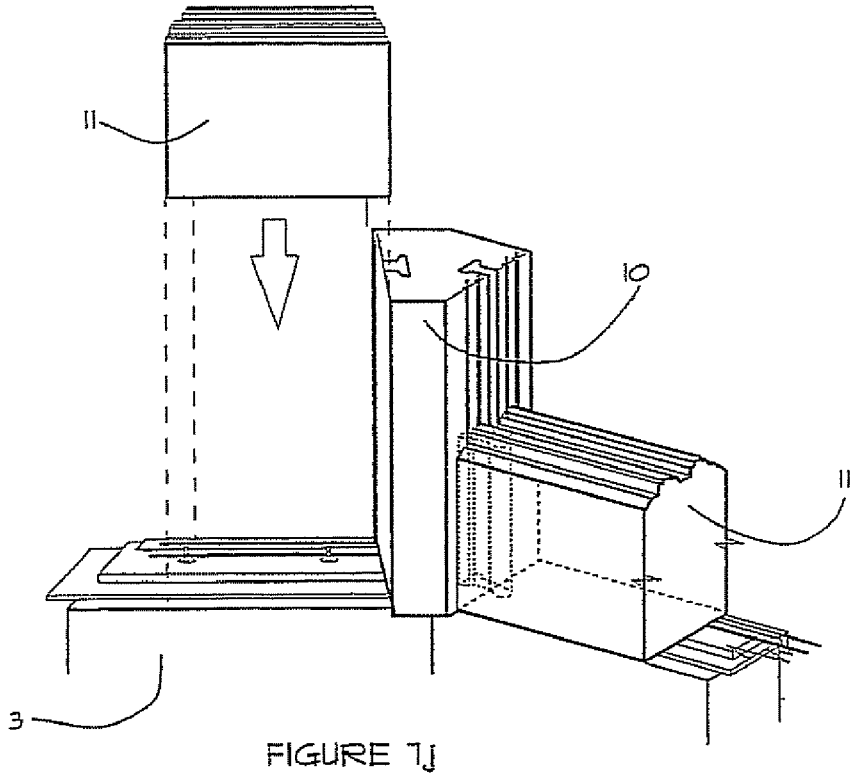
Figure 7K:
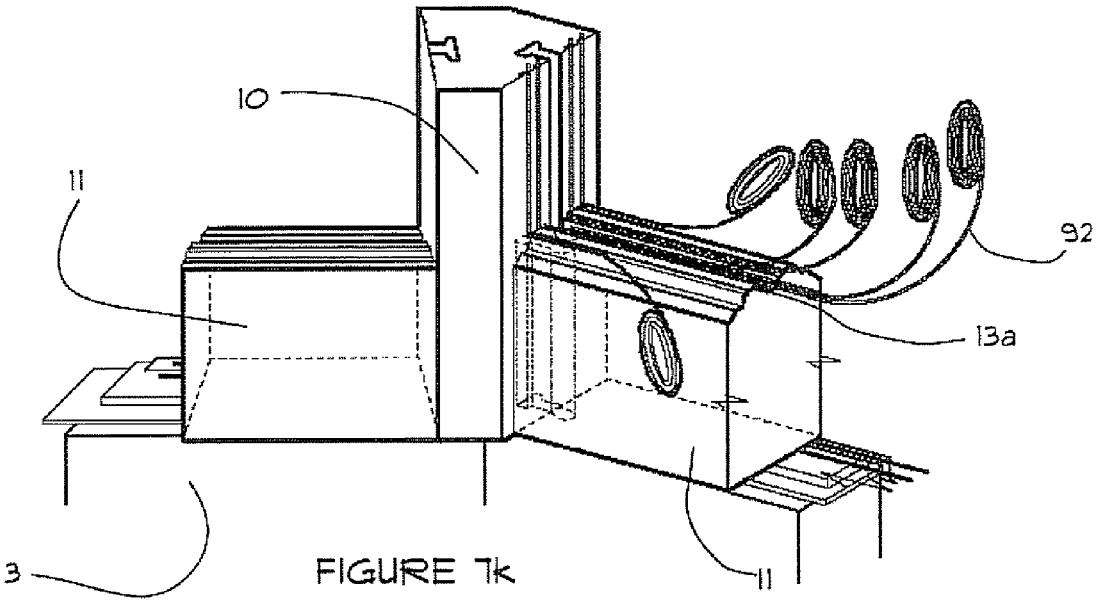

With the initial log in situ, a similar procedure is followed with the log on the opposite face 12 of the post 10 to provide the first row of logs 11 (FIGS. 7*j*-7*k*). The upper surface 13*a* of the log 11 is then prepared by applying sealant strips 92 to the seal grooves on the upper surface of each log 11 and the next log 11 placed in position. The key 32 is then inserted as described above and the process continues up each side of the post 10 until the full height of the log wall 2 has been attained.

During assembly, the weight of each of the logs 11 is sufficient to induce sliding between the key 32 and the key slide 70 to accommodate downward vertical sliding movement of the logs and compression of the sealant strips 92. Optionally, a bolt may be inserted vertically through the log walls 2 and tensioned to force the logs 11 together. As the logs dry, the weight of the logs 11 and the tension in the thru bolt if used, is sufficient to force the key 32 to slide within the key slide 70 and maintain a sealed relationship with the adjacent log 11 and the post 10. The engagement of the embossments 60 with the part cylindrical slot 17 ensures the key 32 moves with the logs 11 and slides within the key slide 70.

Thus, the spline assembly 30 provides a relatively low friction slide member in the post 10 that permits key 32 to slide in a controlled manner within the key slide 70. The key 32 is secured to respective ones of the logs 11 by expansion of the key members 32*a*, 32*b* so as to move with the logs 11 relative to the post 10. In this manner, the integrity of the log walls 2 is maintained by inhibiting gaps from opening between the logs 11.

What is claimed is:

1. A building structure comprising a post having a vertically extending longitudinal face, a plurality of horizontal logs extending from said longitudinal face and having an end face in abutment with said longitudinal face, said post having an undercut channel in said longitudinal face and extending along said post, said end face of at least one of said horizontal logs having a recess aligned with said undercut channel, and a spline assembly extending between said post and at least one of said logs to secure said one log to said post, said spline assembly including a key located in and extending between said undercut channel and said recess to inhibit separation thereof and an insert in one of said undercut channel and said recess, said insert being interposed between said key and opposed walls of one of said undercut channel and said recess and cooperating with said key to facilitate relative sliding movement between at least one of said horizontal logs and said post and said insert.

2. The structure according to claim 1 wherein said key is expandable to secure said key to one of said undercut channel and said recess and said insert permits sliding movement between said key and the other of said undercut channel and said recess.

3. The structure according to claim 1 wherein said insert is formed from a plastics material.

4. The structure according to claim 1 wherein said insert extends continuously along said undercut channel.

5. The structure according to claim 4 wherein said recess provides a re-entrant formation in said log and wherein expansion of said key engages said key with said recess to inhibit relative movement therebetween.

6. The structure according to claim 5 wherein said key has an enlarged head for receipt in said recess.

7. The structure according to claim 6 wherein said recess is part cylindrical and intersects said end face of said log to provide said re-entrant formation.

8. The structure according to claim 6 wherein a sealant is located between said head and said recess and is compressed when said key expands.

9. The structure according to claim 6 wherein said head is connected to said shoulder by a neck and a sealant is interposed between said neck and said recess for compression as said key expands.

10. The structure according to claim 6 wherein said head has embossments on an exterior surface thereof for engagement with a wall of said recess to inhibit relative movement therebetween.

11. The structure according to claim 1 wherein said key includes an enlarged shoulder for receipt in an undercut portion of said undercut channel and said insert is interposed between said shoulder and said undercut channel.

12. The structure according to claim 11 wherein said insert encompasses said shoulder.

13. The structure according to claim 12 wherein said key includes a neck connected to said shoulder and said insert is interposed between a portion of said neck and said undercut channel.

14. The structure according to claim 13 wherein said key is expandable and said insert has a curved surface to promote a rolling action between said neck and said insert as said key expands.

15. The structure according to claim 11 wherein said key is split along a median plane to provide a pair of key members and a wedge is located between said key members to expand said key.

16. The structure according to claim 15 wherein a barrier extends between said key members to constrain said wedge between said key members.

17. The structure according to claim 16 wherein said barrier is formed by a flange on each key member projecting from said median plane and received in a slot on the other key member.

18. A method of assembling a log to a post comprising the steps of providing an undercut channel in a longitudinal face of said post, inserting in said undercut channel a key slide, providing a recess in said log, aligning said recess with said undercut channel, inserting a key into said key slide and positioning said key in said recess to extend between said post and said log and inhibit separation of said post and log, and securing said key to said recess, whereby relative movement between said log and said post is accommodated by relative sliding movement between said key slide and said key.

19. The method according to claim 18 wherein said key is secured by expanding said key in said recess.

20. The method according to claim 19 including the step of inserting a sealant between said recess and said key for compression upon expansion of said key.

21. The method according to claim 19 wherein said key is formed from a pair of key members and expansion of said key is performed by inserting a wedge between said key members.

22. The method according to claim 19 wherein said key is inserted in to said key slide by inserting a first of said key members into said key slide, inserting a second of said key members in to said key slide at a spaced location from said first member and aligning said keys by relative movement along said slide to provide said key.

* * * * *